US006098501A

United States Patent [19]

Sundström

[11] Patent Number: 6,098,501

[45] Date of Patent: Aug. 8, 2000

[54] WRENCH FOR HEXAGONAL NUTS

[75] Inventor: Erik Sundström, Sandviken, Sweden

[73] Assignee: Sandvik Aktiebolag, Sandviken, Sweden

[21] Appl. No.: 09/216,831

[22] Filed: Dec. 21, 1998

[30] Foreign Application Priority Data

Dec. 19, 1997 [SE] Sweden ..... 9704749

[51] Int. Cl.[7] ..... B25B 13/06

[52] U.S. Cl. ..... 81/121.1; 81/119; 81/186

[58] Field of Search ..... 81/121.1, 119, 81/124.3, 186

[56] References Cited

U.S. PATENT DOCUMENTS 3,242,775 3/1966 Hinkle .
4,126,063 11/1978 Palmer .
4,930,378 6/1990 Colvin .
5,148,726 9/1992 Huebschen et al. ..... 81/119
5,481,948 1/1996 Zerkovitz .
5,806,383 9/1998 Hsieh ..... 81/170
5,832,792 11/1998 Hsieh ..... 81/121.1 X
5,860,339 1/1999 Mikic et al. ..... 81/121.1 X

*Primary Examiner*—D. S. Meislin
*Attorney, Agent, or Firm*—Burns, Doane, Swecker & Mathis, L.L.P.

[57] ABSTRACT

A wrench for rotating hexagonal fasteners includes an opening defined by a sidewall. The sidewall includes a plurality of contact surfaces for contacting respective sides of the fastener. Each contact surface includes two groups of generally parallel ridges separated by a recessed portion. Each of the ridges has a convexly curved top for contacting a side of the fastener.

14 Claims, 3 Drawing Sheets

WRENCH FOR HEXAGONAL NUTS

BACKGROUND OF THE INVENTION

The present invention relates to wrenches.

When nuts are to be tightened or loosened with fixed wrenches, it is important that deviations in the shape of the nuts do not cause damage to the nuts or to the wrenches. Two types of shape deviation are especially important to consider: corner damage and differences in the across-flat dimension. It is also important that the wrenches are able to be used for nuts which are coated with paint or rust-protective layers.

In order not to cause or worsen damage to the nuts, the force acting from the wrench on the nut should be spread over a sufficient surface so as not to damage surface coatings, and should not act too near the corners. The force should be relatively close to normal to the surface, since frictional shear forces can easily damage coatings. The force value for a given torque depends on the leverage, measured as the distance from the line of the force to the center line of the nut. If the force becomes excessive there is also an elastic deformation of the wrench which makes the angular motion indistinct and may cause large stresses; in severe cases the wrench may break.

In the simplest types of wrenches the jaws or contact surfaces are flat. This means that undersize nuts are contacted only at the corners, which are easily damaged. On nuts where the corners are already damaged, the forces will then act closer to the center of the sides and become so large that the wrench may be damaged and the angular motion indistinct.

In patents U.S. Pat. Nos. 3,242,775 and 4,930,378 it has been suggested that the jaws of the wrench be made convex with large radius to spread the force over a larger area, but for such wrenches the contact point will vary very much with the across-flat dimension, and oversize nuts will overstress the wrench. If the wrench is made as in U.S. Pat. No. 5,481,948 with jaws which are flat with convexly rounded ends, the forces will be acceptable and the contact points relatively independent of the across-flat dimension, but for nuts with damaged corners, the forces will be excessive and likely to worsen the damage. If the jaws are made with fully serrated surfaces as in U.S. Pat. No. 4,126,063 the forces on nuts with corner damage will be limited since frictional shear forces are utilized, but this may hurt painted or galvanized nuts. It is also known to make jaws which are serrated on the inner half and flat on the outer half, with the purpose of pulling the nut into the gap between the jaws.

SUMMARY OF THE INVENTION

The present invention relates to a wrench for rotating hexagonal fasteners. The wrench includes an opening defined by a side wall. The side wall includes a plurality of contact surfaces for contacting respective sides of the fastener. Each contact surface includes two groups of generally parallel ridges separated by a recessed portion. Each of the ridges has a convexly curved top for contacting a side of the fastener.

The present invention also relates to a method of engaging a six-sided fastener with the wrench, wherein the tops of each group of ridges is situated within a distance from an adjacent corner of the fastener. The distance is from 10 to 35% of the length of a side of the fastener.

According to the invention, the jaws or contact surfaces exhibit: a well defined contact point for the forces, virtual independence of shape deviations of the nut, limited force values and little risk of surface damage.

BRIEF DESCRIPTION OF THE DRAWING

Preferred embodiments of the invention are described with reference to the figures, wherein.

DETAILED DESCRIPTION OF PREFERRED EMBODIMENTS OF THE INVENTION

Figure 1:
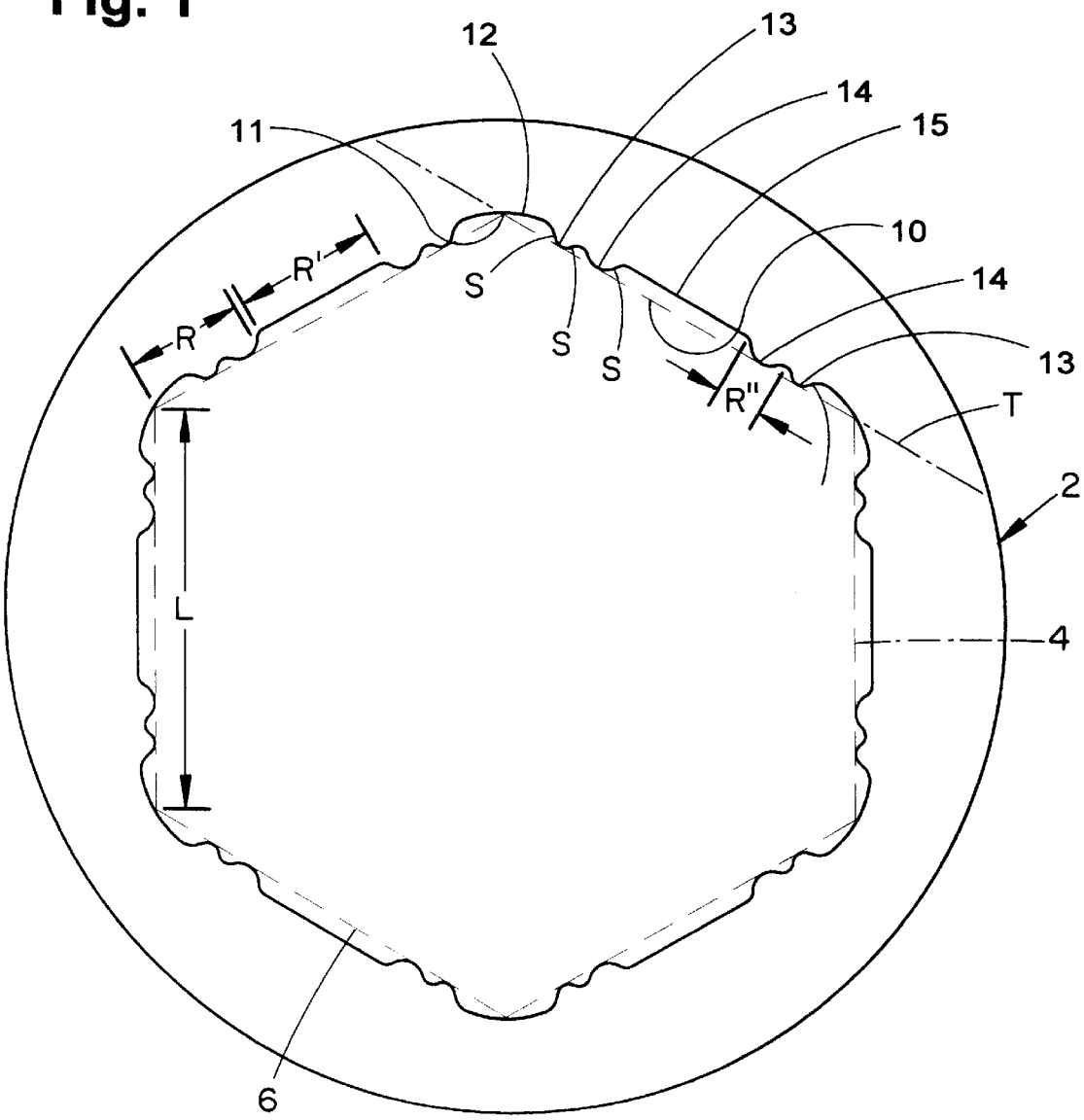
FIG. 1 shows a socket or box wrench with hexagonal profile according to the invention.

A hexagonal wrench (2) according to FIG. 1 is used to rotate a hexagonal nut or bolt (4) having six flat sides (10) and six corners (11) which may theoretically be sharp, but in practice are always somewhat rounded from the manufacture or from later wear or corrosion. The wrench includes an opening (6) formed by a continuous sidewall. The sidewall includes recesses (12) for receiving the corners of the nut. Forces near the corners (11) should be avoided since they may easily damage the nut, and the wrench is thus made with rounded recesses (12) with circular or oval section. The wrench is provided with contact surfaces each having a group (two) of parallel ridges on each side of the recess (12), namely, a first or inner ridge (13) located near the recess and one second or outer ridge (14) located farther from the recess. Between the pairs of ridges the contact surface has a substantially straight portion (15) which is recessed relative to the ridges so it will not touch the flat side (10) of a nut. This makes it easier to use the wrench for nuts with severe previous corner damage. If the side were to contact the wrench between adjacent pairs of ridges, the leverage would be too small, and the force so large that the wrench might break. The ridge tops, the concave valleys between the ridges, and the transition from the ridges to the recess and to the center portion should preferably be rounded to reduce the risk of surface damage to the nut. The ridges have convexly curved tops which make contact with the fastener. The side 10 of the nut coincides with a line T which constitutes a tangent which is common to the convexly curved tops of all four of the ridges 13, 14 of the respective contact surface. The sides S of all the ridges are inclined relative to the tangent.

Figure 2:
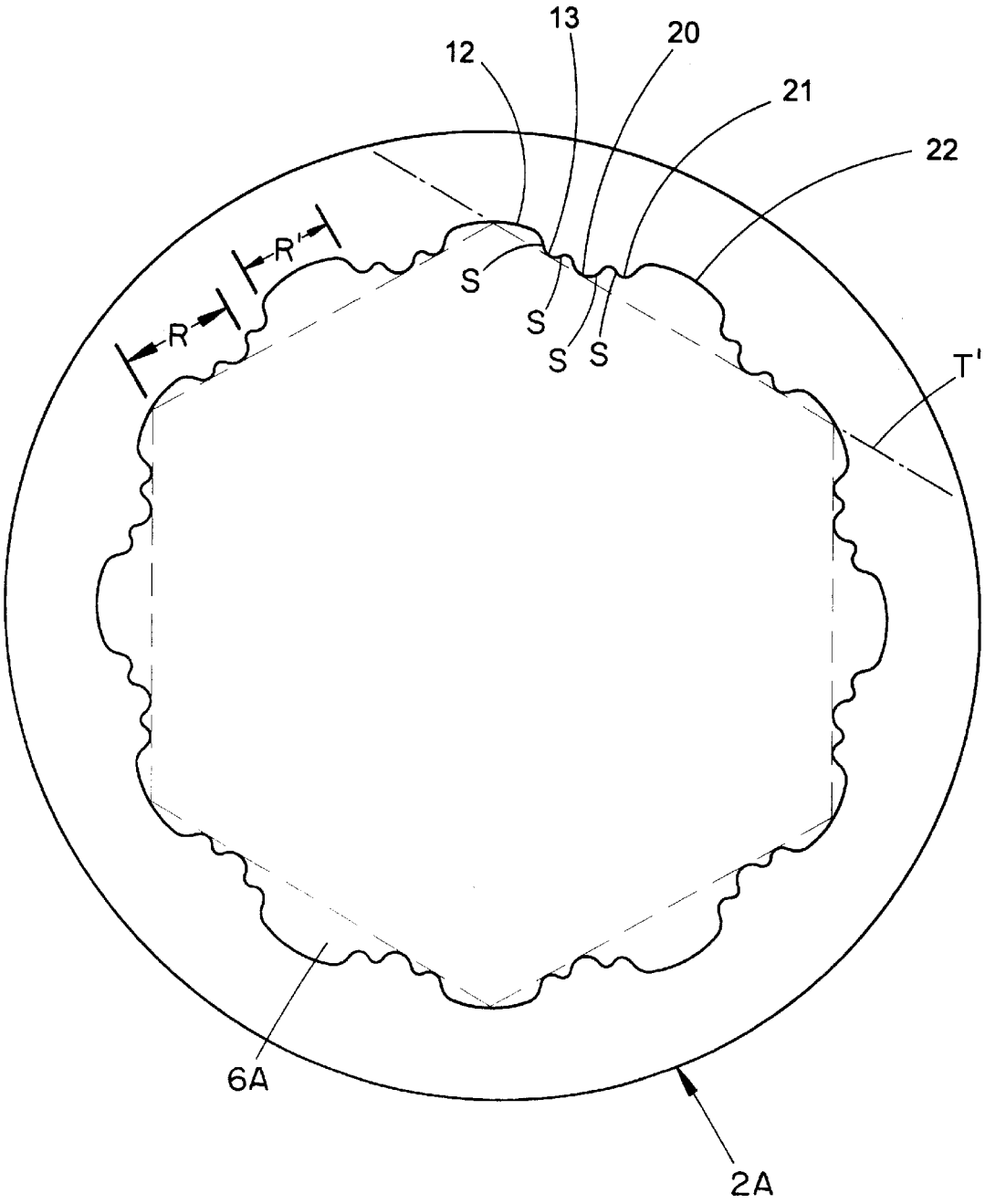
FIG. 2 shows a socket or box wrench with a dodecagonal profile according to the invention.

FIG. 2 shows a dodecagonal wrench (2A), which has the advantage, compared to a hexagonal wrench, of admitting more angular positions and being slightly lighter, but it may be more sensitive to certain kinds of shape deviations. The sidewall profile of the wrench opening (6A) is similar to that of the hexagonal wrench, but instead of a recessed center portion (15) there is a recess (22) with the same shape as the recess (12) which receives the corner of the nut. Each group of ridges disposed between the recesses (12, 22) comprises three ridges (13, 20, 21) having convexly curved tops. The three ridges of each group project toward the nut by different distances, i.e., the ridges are of different height. The middle ridge (20) has a greater height than the other two ridges, whereby only two of the ridges of each group can contact the fastener, depending upon which of the recesses 12, 22 receive the corners of the fasteners. That is, the curved tops of four of the six ridges on each contact surface have a common tangent T'.

Figure 3:
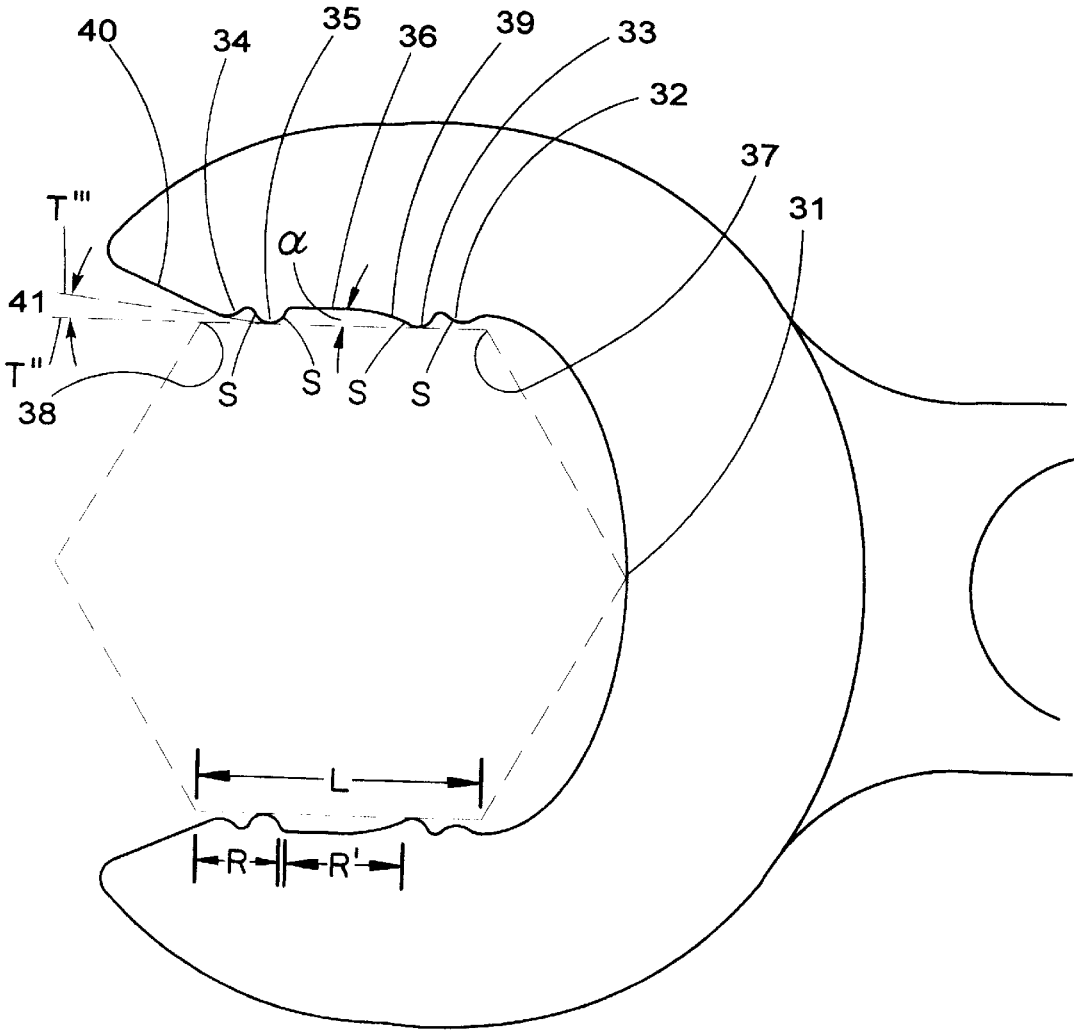
FIG. 3 shows an open wrench according to the invention.

FIG. 3 shows an end of an open fixed wrench (2B) having an opening (6B) formed by two jaws. Each jaw includes a portion of a non-continuous sidewall. The opening is closed at a rear end and open at a front end. The jaws form respective contact surfaces according to the invention. Each contact surface includes two inner ridges (33, 35), two outer ridges (32, 34) and one recessed center portion (36). The groups of ridges are located so that they are all disposed between the corners (37, 38) of the side of the hexagon which they are to contact when the nut is inserted into the wrench as far as possible, which may be when one corner (31) touches the wrench bottom (42) extending between the jaws. The top of one of the ridges 35 of each group of ridges has common tangent T" with the top of one ridge 35 of the other group. The other ridges 34 are spaced outwardly from the tangent T". The center portion (36) is so deeply recessed that it cannot touch a fully inserted nut, and its transition (39) to the inner ridge (33) has such a smooth slope, preferably forming an angle $\alpha$ less than 30 degrees, with the tangent T" that the corner (37) of the nut will slide over the ridge (33) without stopping when the nut is being inserted. Like the ridges of FIGS. 1 and 2, the ridges 32–35 have convexly curved tops.

The front ends (40) of the jaws should be made forwardly divergent to facilitate insertion of the nut, and may be either flat or convex.

To distribute the forces between the ridges when working with standard size nuts, the outer ridges (32, 34) should preferably be slightly lower than the inner ridges (33, 35), so that the flat side of a nominal size nut will touch only two adjacent ridges (34, 35 or 32, 33). Oversize or corner-damaged nuts will only touch the ridge (33 or 35) located closer to the center portion 36, and undersize nuts will only touch the ridge (32 or 34) located farther from the center portion. The height difference between the ridges should be such that the common tangent line T' to the tops of two adjacent ridges forms an angle (41), not greater than 3 degrees, with the side of a maximum size nut.

In each embodiment of the invention, the tops of each group of ridges should all lie within a distance R measured from the respective corner of a maximum size nut, the distance being 10% to 35%, preferably 12% to 30% of the length L of the side of the nut. Also, the length R' of the recessed center portion, which is longer than a maximum length R" of a ridge, should comprise at least 30%, preferably at least 40% of the length L of the side.

Providing the jaw with pairs of adjacent ridges will, in comparison with flat or fully convex jaws, make the contact points well defined with a distinct grip and result in a reduced risk of damaging the wrench or the nut.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A wrench for rotating hexagonal fasteners, the wrench including an opening defined by a sidewall, the sidewall including a plurality of contact surfaces for contacting respective sides of the fastener, each contact surface including first and second groups of generally parallel ridges separated by a recessed portion having a length longer than a maximum length of a ridge, each of the ridges having a convexly curved top for contacting a side of the fastener, the convexly curved top of at least one ridge in the first group having a common tangent with the convexly curved top of at least one ridge in the second group, each of the ridges of all of the groups having side faces inclined relative to the common tangent.

2. The wrench according to claim 1 wherein each group of ridges consists of two ridges.

3. The wrench according to claim 1 wherein the sidewall extends continuously.

4. The wrench according to claim 1 wherein the sidewall is non-continuous and portions thereof are formed by spaced-apart jaws, each jaw forming one of the contact surfaces.

5. The wrench according to claim 4 wherein the opening is closed at one end and open at an opposite end for receiving the fastener, a surface of each of the recessed portions facing generally toward the open end having a slope less than 30 degrees to facilitate travel of a corner of the fastener therepast during insertion of the fastener.

6. The wrench according to claim 4 wherein the opening is closed at a rear end and open at a front end for receiving a fastener, front ends of the jaws being forwardly divergent to facilitate entry of the fastener into the opening.

7. The wrench according to claim 1 wherein there are six contact surfaces.

8. The wrench according to claim 1 wherein the contact surfaces are separated from one another by recesses formed in the sidewall, the recesses arranged for receiving respective corners of the fastener.

9. The wrench according to claim 8 wherein a first ridge of each of the first and second groups being situated closest to an adjacent recess and being of less height than a second ridge situated next to the first ridge, the second ridges of the first and second groups constituting the ridges having a common tangent.

10. The wrench according to claim 9 wherein the common tangent constitutes a first tangent, a second tangent extending tangent to the first and second ridges forms an angle not greater than 3 degrees with the first tangent.

11. The wrench according to claim 8 wherein the recesses are shaped identically to the recessed portions.

12. The wrench according to claim 11 wherein each group of ridges consists of three ridges, the common tangent being common to the convexly curved tops of only two of the three ridges of each group.

13. The wrench according to claim 2 wherein the common tangent is common to the convexly curved tops of all four of the ridges disposed along each contact surface.

14. A method of engaging a six-sided fastener with a wrench, the wrench comprising an opening defined by a sidewall, the sidewall including a plurality of contact surfaces for contacting respective sides of the fastener, each contact surface including two groups of generally parallel ridges separated by a recessed portion, each of the ridges having a convexly curved top, each of the recessed portions having a length of at least 30% of a length of a side of the fastener, the method comprising the step of inserting the fastener into the opening such that at least two sides of the fastener are engaged by ridges of respective contact surfaces, the convexly curved tops of each group of ridges being situated within a distance from an adjacent corner of the fastener, the distance being from 12 to 30% of the length of a side of the fastener, and the length of the recessed portion being at least 40% of the length of the side of the fastener.

* * * * *